United States Patent [19]

Schreder

[11] Patent Number: 4,697,068

[45] Date of Patent: Sep. 29, 1987

[54] ELECTRIC COOKER HEATING UNIT

[75] Inventor: Felix Schreder, Oberderdingen, Fed. Rep. of Germany

[73] Assignee: E.G.O. Elektro Geräte Blanc u. Fischer, Fed. Rep. of Germany

[21] Appl. No.: 865,171

[22] Filed: May 20, 1986

[30] Foreign Application Priority Data

May 25, 1985 [DE] Fed. Rep. of Germany ..... 3519035
May 25, 1985 [DE] Fed. Rep. of Germany ... 8515560[U]

[51] Int. Cl.[4] ..... H05B 3/76

[52] U.S. Cl. ..... 219/449; 337/383; 219/448; 219/466; 219/512

[58] Field of Search ..... 219/448, 449, 450, 516, 219/459, 461, 465, 466, 467, 468, 462, 464, 458, 512; 337/382, 383, 391, 393, 394, 397

[56] References Cited

U.S. PATENT DOCUMENTS

| | | | |
|---|---|---|---|
| 2,140,479 | 12/1938 | Myers | 219/516 |
| 2,418,867 | 4/1947 | Burch | 337/394 |
| 4,135,081 | 1/1979 | Fischer | 219/449 |
| 4,577,176 | 3/1986 | Bayer | 337/394 |

FOREIGN PATENT DOCUMENTS

| | | | |
|---|---|---|---|
| 376540 | 11/1984 | Austria . | |
| 1123059 | 8/1962 | Fed. Rep. of Germany . | |
| 2118407 | 10/1972 | Fed. Rep. of Germany . | |
| 2221874 | 11/1973 | Fed. Rep. of Germany . | |
| 2500586 | 7/1976 | Fed. Rep. of Germany | 219/464 |
| 2604783 | 7/1976 | Fed. Rep. of Germany . | |
| 2422625 | 2/1977 | Fed. Rep. of Germany . | |
| 2627373 | 12/1977 | Fed. Rep. of Germany . | |
| 2620004 | 9/1978 | Fed. Rep. of Germany . | |
| 3131462 | 2/1983 | Fed. Rep. of Germany . | |
| 3234349 | 3/1984 | Fed. Rep. of Germany | 219/448 |
| 3301689 | 7/1984 | Fed. Rep. of Germany . | |
| 1117223 | 5/1956 | France | 337/383 |
| 1196719 | 11/1959 | France . | |
| 51376 | 11/1966 | German Democratic Rep. . | |
| 2103910 | 2/1983 | United Kingdom . | |

*Primary Examiner*—E. A. Goldberg
*Assistant Examiner*—Teresa J. Walberg
*Attorney, Agent, or Firm*—Steele, Gould & Fried

[57] ABSTRACT

A heating unit for cooking points, baking oven muffles or the like is provided on the inside of its outer body (2), in the central zone (10), with two thermal cutouts (17, 18), which are preferably located in a common cutout casing (19) exclusively located in said central zone (10) and sense with their temperature sensors (24, 25) different regions of the heating surface or outer body (2). The differently set thermal cutouts (17, 18) and the heating resistors (7, 8, 9) separately connected into the leads ensure a differentiated disconnection of a more or less large part of the heating power, so that rerliable protection against overheating is ensured, in the case of a compact construction.

40 Claims, 14 Drawing Figures

ELECTRIC COOKER HEATING UNIT

The invention relates to an electric cooker heating unit with a heating surface provided on an outer body and behind which, outside a central zone, are arranged a plurality of heating resistors to be operated via a power control device, whereof at least one can be disconnected by means of a thermal cutout positioned behind the heating surface, said cutout having a casing arranged in the central zone and a temperature sensor for the outer body, as well as a switching temperature setting.

It is known in connection with heating units constructed as electric hotplates to disconnect the complete heating system or part thereof by one or two thermal cutouts in order to protect the hotplate and its surrounding area against overheating if e.g. manual disconnection on the power control device has been forgotten. An important part in connection with reliable protection is played in particular by the inertia of the temperature switch, especially as disconnection can take place too late in the case of a very rapid temperature rise in the outer body of the hotplate body. Furthermore, the degree of thermal coupling between temperature sensor and hotplate is important for the response precision of the temperature switch. It has been found in the hitherto known hotplates that the resulting requirements are not always satisfactorily fulfilled. This in particular applies to hotplates having as the main heating system, e.g. three heating resistors, which can be connected in parallel and are operated by means of a timing power control device or a multi-position timing switch, e.g. a seven-position timing switch. Such electric hotplates, which can also have a separate, further additional heating resistor, disconnectable by means of its own temperature switch, for a brief, high initial cooking power, often cause difficulties during the disconnection of part of the main heating system due to the high remaining residual power, which under unfavourable conditions can still lead to overheating. However, a disconnection of the total power of the main heating system by thermal cutouts is not always desired under those operating conditions which occur near a possible overheating, because as a result of the usually relatively high switching hysteresis of the thermal cutout, there can be a significant cooling of the hotplate body until the main heating system becomes once again operable.

The problem of the invention is to provide an electric cooker heating unit of the described type which, in the case of a simple and compact construction, under operating conditions which can approach the overheating range and in adaptation to the particular operating conditions, permits a differentiated disconnection of a smaller or larger part of the heating power of the main heating system, so that in the case of a residual, not disconnected power, the latter cannot lead to overheating and at the same time a relatively high operating temperature of the heating unit can be maintained for the further use thereof.

According to the invention this problem is solved in the case of an electric cooker heating unit of the aforementioned type in that two thermal cutouts with separate temperature sensors and differing settings are provided and the particular casing of both thermal cutouts is arranged in the central zone. Through the choice of the position and construction of both the temperature sensors and the thermal cutouts, the thermal coupling to the heating surface, as well as the switching temperature, switching inertia and switching hysteresis can be so matched between the two thermal cutouts that only in the case of a very high risk of overheating is most of the power or total power of the main heating system disconnected, whereas in the case of a slower temperature rise under otherwise identical temperature conditions, only a smaller proportion of the power of the main heating system is disconnected by a single temperature responsive switch. The cutout casings can be made very compact and space-saving, i.e. without influencing the other installation conditions of the heating unit and the power control device, it is possible to locate them in the vicinity of the central zone of the outer body. This again leads to a very accurately determinable thermal coupling to the heating surface, without it being necessary to provide same with an opening for receiving the temperature sensor and instead there can be a completely closed surface as the exposed cooking surface.

According to another feature of the invention, in plan view the two temperature sensors are arranged in different zones of the outer body, particularly so as to approximately diametrically face one another, so that they advantageously separately sense different regions of the heating surface or outer body, and can immediately detect local overheating.

A particularly advantageous further development of the inventive object is obtained in that both thermal cutouts have a common cutout casing, which is preferably provided with an opening for the engagement of a central fixing projection of the outer body projecting from the underside. Thus, particularly in the case of a cast iron electric hotplate with a space-saving construction and in a simple manner, it is possible to accurately orient both thermal cutouts with respect to the central axis of the outer body constructed as the hotplate body, which further increases the response accuracy thereof. However, it is also conceivable for the two thermal cutouts to have separate casings, which are preferably located on either side of the central fixing projection of the outer body, so that they are spaced from one another in non-contacting manner and do not influence one another.

A particularly intensive thermal coupling of the temperature sensor and therefore a very rapid response of the associated thermal cutout can in particular be obtained if the temperature sensor of at least one thermal cutout extends outside an inner ring of the hotplate body projecting at the underside and defining the central zone and is therefore directly influenced by that region in which the heating resistors are located. This can be further improved in that the temperature sensor extends radially over the area provided with heating resistors.

The heating unit monitored by the particular temperature sensor can be made relatively extensive, if two rod-like temperature sensors are located opposite the central axis of the outer extending in different directions, preferably diametrically opposite and/or continuously at the same height.

It has proven advantageous to use at least one expansion rod sensor and/or at least one bimetallic sensor as the temperature sensors. It is conceivable to use two temperature sensors with the same active principle and/or construction or two temperature sensors having different active principles, i.e. for example an expansion rod sensor and a bimetallic sensor, which permits a further differentiation of the switching behavior of the two thermal cutouts.

For protected positioning and for simple fitting, both thermal cutouts are located within a cover arranged on the inside or underside of the outer body or hotplate body and to which they are preferably jointly fixed with respect to the outer body or the hotplate body.

According to a further inventive proposal, the two thermal cutouts are connected into separate leads, particularly into two of a total of four leads between the power control device and the heating resistors. A particularly advantageous construction is obtained if a thermal cutout is connected into the common lead of two heating resistors, more particularly having different power ratings or if in addition thereto or instead thereof the two thermal cutouts are in each case connected into the lead of one of the two maximum power heating resistors, whereby said two heating resistors can in particular have the same power. For example the two maximum power heating resistors can dissipate 850 watts and the third heating resistor 300 watts, so that by means of a power control device constructed as a seven-step timing switch, they can be operated in six different power stages. Such a seven-timing switch is described in German Pat. No. 26 04 783 (equivalent to British Pat. No. 15 77 852), to which reference is made.

The inventive heating unit is suitable for heating a cooking point, a baking oven muffle or the like. It can be constructed as an electric hotplate, as a radiant heating body with exposed heating resistors and/or with lamp bulbs, as contact heaters and the like.

These and further features of the preferred further development of the invention can be gathered from the description and drawings, whereby the individual features can be realised singularly or in the form of sub-combinations in a particular embodiment of the invention and in other fields. Embodiments of the invention are represented in the drawings and are described in greater detail hereinafter relative to said drawings, wherein show:

FIG. 1, a view from below of a heating unit according to the invention constructed as an electric hotplate.

FIG. 2, an elevational view of the hotplate according to FIG. 1.

FIG. 3, two thermal cutouts in integrated construction with the cutout casing open in a view from below.

FIG. 4, part of an electric hotplate in section with a thermal cutout according to FIG. 3.

FIGS. 5 to 8, four further embodiments of hotplates in detail representations according to FIG. 1.

FIGS. 9 to 11, circuit diagrams for hotplates.

FIG. 12, a heating unit constructed as a contact heater in a view of the underside.

FIG. 13, an axial section through FIG. 12 on a larger scale.

FIG. 14, a heating unit constructed as a radiant heater in axial section.

DETAILED DESCRIPTION OF THE PREFERRED EMBODIMENTS

Figure 1:
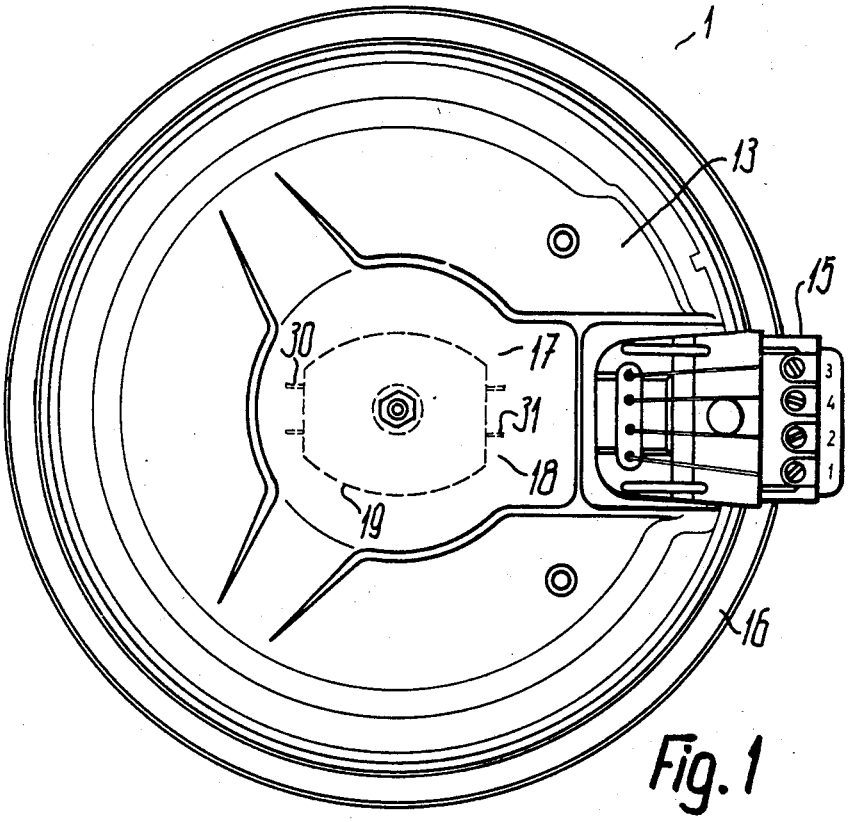
Figure 2:
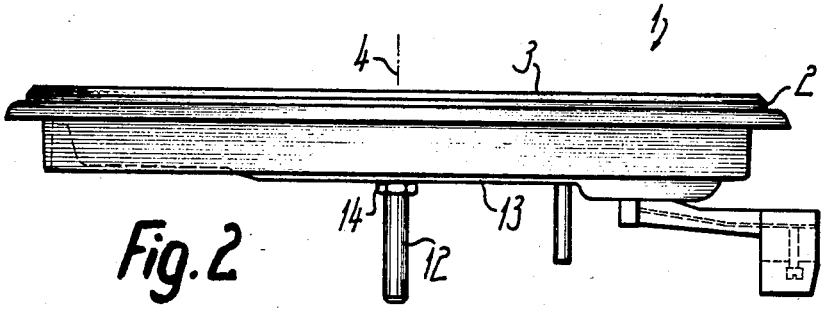

As shown in FIGS. 1 to 4, an inventive electric hotplate 1 has as the outer body a cast material hotplate body 2, whose planar, substantially circular top surface forms the heating surface in the form of a cooking surface 3 and over whose under side axially project two concentric rings around the central axis 4 thereof, namely an outer ring 5 displaced slightly inwards with respect to its outer circumferential surface and an inner ring 6, the latter projecting much less far down than the outer ring 5. In the ring zone between outer ring 5 and inner ring 6 are provided in the underside of hotplate body 2, three spiral grooves, separated by narrow spiral rib webs and in each of which is inserted a helical heating resistor 7 to 9 and embedded in a heat-resistant insulating material in contact-free manner with respect to hotplate body 2. Heating resistors 7 to 9 form the main heating system of hotplate 1, which is provided for the normal operation of the hotplate, which can be operated in six power stages.

Figure 10:
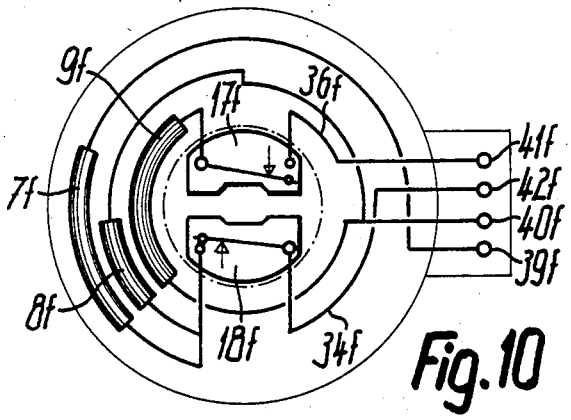
Figure 11:
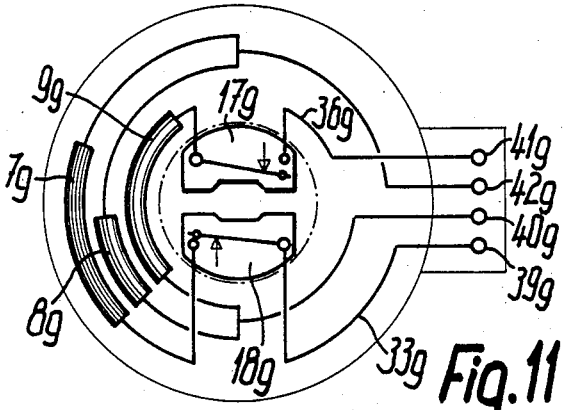

On the periphery, inner ring 6 defines a central zone 10 of hotplate body 2 free from heating bodies and in whose vicinity the hotplate body has a recess on the top surface and has on the underside a cast lug-like projection 11 projecting downwards in the central axis 4, which with the inner ring 6 defines on the underside of hotplate body 2 a recessed ring-like region. Projection 11, which projects beyond the lower end face of inner ring 6 and is located with its lower end face roughly in the plane of the lower end face of outer ring 5, serves to receive a downwardly projecting stay bolt 12, and which the electric hotplate is fixed in a hob or the like. Projection 11 with stay bolt 12 are simultaneously used for fixing a cover 13 provided on the underside of hotplate body 2, which can e.g. be shaped from sheet metal in cup-like manner and closes the underside of hotplate body 2 with spacing with respect to the heating resistor 7 to 9, as well as the inner ring 6, whereby it engages with its base wall on the lower end face of projection 11 and is secured with respect thereto by a nut 14 arranged on stay bolt 12 as the single fixing means. Cover 13 extends up to the inner face of outer ring 5 and can be provided in this region with a tray defining circumferential wall extending to the level of the rib webs between heating resistors 7 to 9. To the hotplate body 2 is also fixed a connecting block 15 with four connecting terminals projecting radially on the underside and with which the heating resistors 7 to 9 are electrically conductively connected according to FIGS. 9 to 11. On the underside of outer ring 5 provided a sheet metal spillage rim 16, not shown in FIG. 4, which forms the connection of the outer circumference of the hotplate to the cooker or the like.

Figure 4:
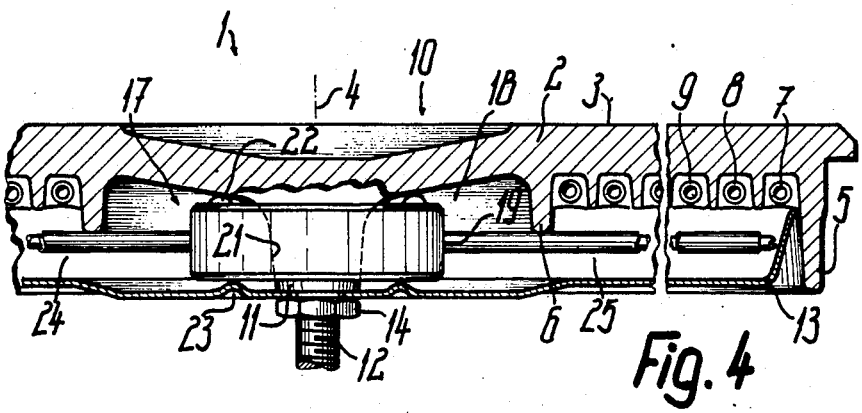

In the central zone 10 are provided on the underside of hotplate body 2, two electrically separately switched thermal cutouts 17, 18 in a common casing 19 made of ceramic material or the like. The cutout casing 19 is substantially symmetrical to central axis 4 and has therein an opening 21 for the passage of projection 11. At its top surface, cutout casing 19 according to FIG. 4 is adjacent to projection 11 and engages on the underside of hotplate body 2 within inner ring 6, i.e. in the central zone 10, the cutout casing 19 being spaced all-round from the inner face of inner ring 6. Cutout casing 19 can be provided on its top surface with attachment studs 22 or similar projections for engaging on the underside of hotplate body 2. The base wall of cover 13 is elastically pretensioned on the underside of cutout casing 9 and for this purpose cover 13 can e.g. be provided with upwardly projecting spring studs 23 or the like.

Figure 3:
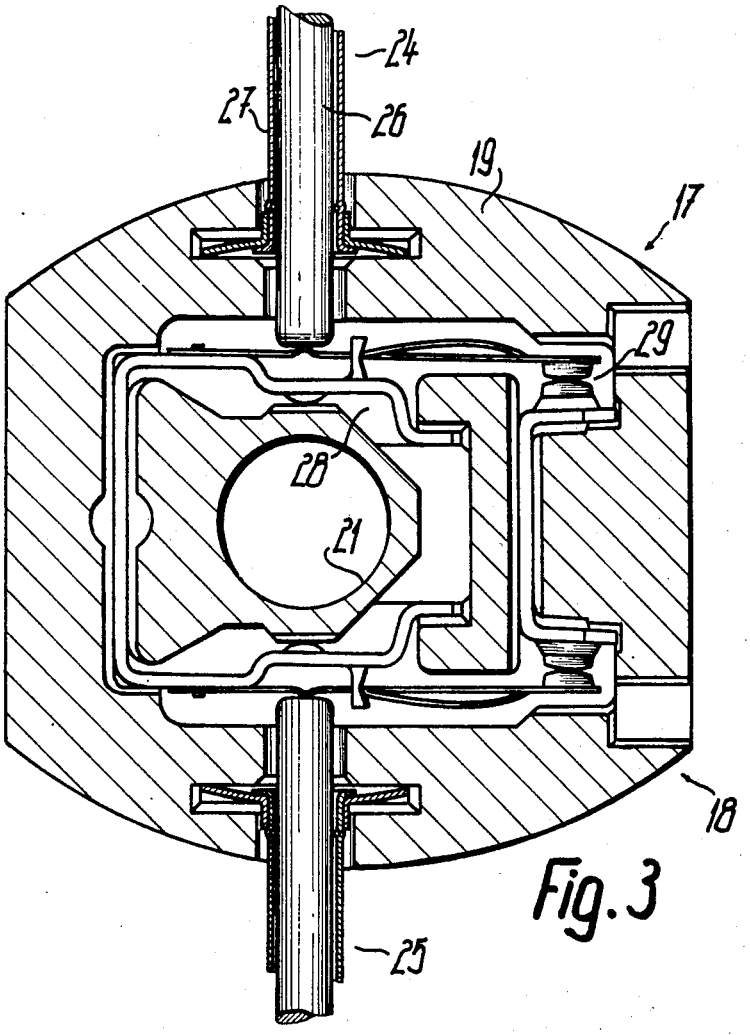

The two thermal cutouts 17, 18 are e.g. constructed as expansion rod cutouts according to FIG. 3, which in each case have a rod-like temperature sensor 24, 25 projecting over the cutout casing 19. The temperature sensors are not shown in FIG. 1. The thermal cutouts according to FIG. 1 can also have temperature sensors, which are located within the cutout casing 19 and e.g.

constructed as bimetallic sensors. Each temperature sensor 24, 25 according to FIG. 3 has an inner expansion rod 26 in an outer tube 27, which is anchored by one end in cutout casing 19 and in the other, free end (not shown in FIG. 3) carries a set screw, on which is axially supported by its associated end face the expansion rod 26. The other end of expansion rod 26 located in the cutout casing 19 acts on a snap-action switch housed in casing 19 and whose contacts 29 are closed in one position and in the other position corresponding to a higher sensor temperature are open. Both snap-action switches 28 are arranged in a substantially mirror symmetrical manner in cutout casing 19, but are electrically connectable independently of one another. Passage 21 passes through cutout casing 19 between the snap-action switches 28.

As is particularly shown in FIGS. 3 and 4, the two temperature sensors 24, 25 are equiaxial to one another, whilst freely oppositely projecting from cutout casing 19, their central axes being e.g. located radially to the central axis 4. In addition, the two temperature sensors 24, 25 are at the same height, preferably in such a way that they are parallel to cooking surface 3 with the thermal cutout fitted in place and extend at least approximately into the radially outermost region of heating resistors 7 to 9, i.e. into the vicinity of the inner face of outer ring 5 or the circumferential wall of cover 13 and engage with limited force on the underside of inner ring 6. Thus, a precisely determined spacing is ensured over the entire length of temperature sensors 24, 25 between the latter and the heating resistors 7 to 9, in particular in such a way that the temperature sensors 24, 25 are located roughly in the centre between heating resistors 7 to 9 and the underside of hotplate body 2 or cover 13.

Connecting terminals or connectors 30, 31, which are provided for electrically conductive connection of the thermal cutouts 17 to 18 to the heating resistors on cutout casing 19, can be positioned on opposite sides of casing 19 and preferably the connectors 30 or the like of at least one thermal cutout are arranged on the side of cutout casing 19 facing connecting block 15, in order to ensure short line connections.

In FIGS. 5 to 14 corresponding parts carry the same reference numerals as in FIGS. 1 to 4, but are followed by different letter references.

Figure 5:
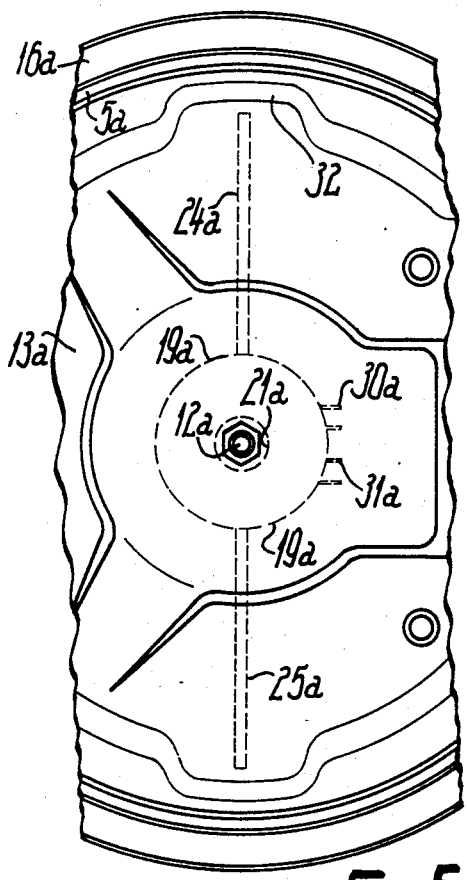

In the embodiment according to FIG. 5, the cutout casing **19*a* in which two thermal cutouts are housed is circular in plan view, so that it can be particularly readily housed in the central zone. All the connectors 30*a*, 31*a* are juxtaposed in parallel on one side of the cutout casing 19*a*, namely on that side facing the connecting block. In order that the temperature sensors 24*a*, 25*a* can be made as long as possible or can project outwards as far as possible, cover 13*a* is provided on its circumferential wall in the vicinity of the ends of said temperature sensors 24*a*, 25*a* with bulges 32, which extend virtually up to the inner face of outer ring 5*a***.

Figure 6:
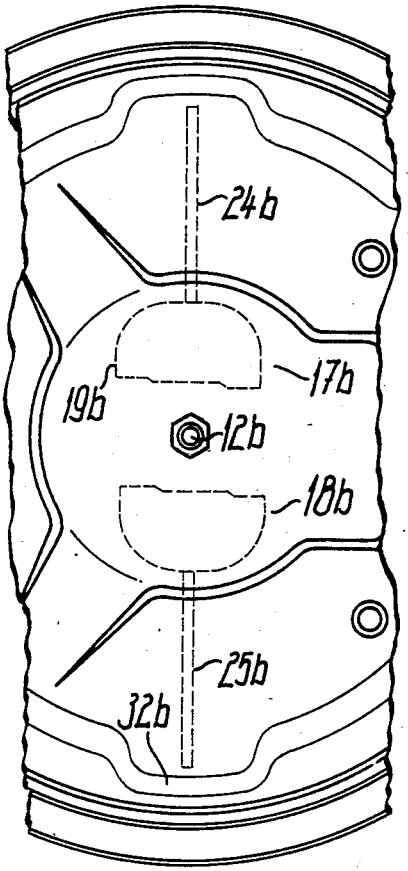

As shown in FIG. 6, the two thermal cutouts **17*b*, 18*b* can also have separate casings 19*b*, 20*b*, which appropriately face one another in spaced manner on either side of the central axis of the hotplate body, so that the projection receiving the stay bolt 12*b* is located between them on the underside of the hotplate body. According to FIG. 6, the two thermal cutouts 17*b*, 18*b*** are identical and arranged in mirror symmetrical manner.

Figure 7:
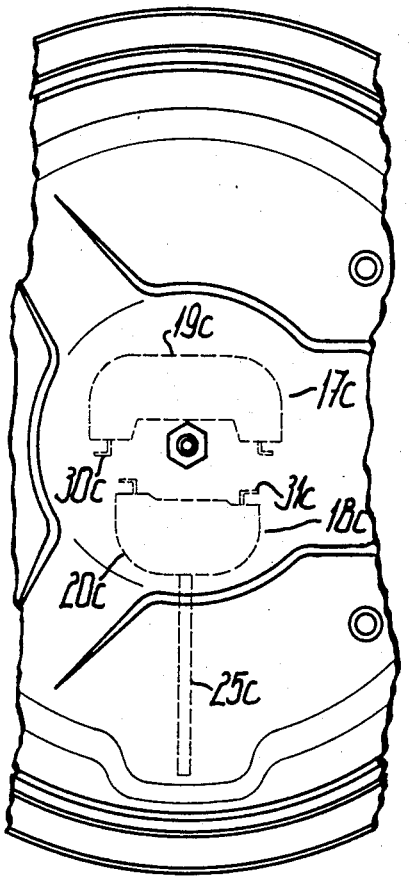

According to FIG. 7 two differently constructed thermal cutouts **17*c*, 18*c* operating according to different active principles are arranged at least with their cutout casings 19*c*, 20*c* in the central zone. The cutout casings 19*c*, 20*c* are located on either side of an axial plane of the hotplate body, which simulatenously forms the central plane of the connecting block 15 (not shown in FIG. 7) according to FIG. 1, the connectors 30*c*, 31*c* being provided on facing sides of the cutout casing 19*c*, 20*c*. Thermal cutout 17*c* is e.g. constructed as a bimetallic cutout, whose temperature sensor, formed by a bimetal, is located within the cutout casing 19*c* and which is e.g. constructed according to German Pat. No. 11 23 059, to which reference should be made for further details and features. The other thermal cutout 18*c* has as the temperature sensor 25*d*** an expansion rod sensor, which projects at right angles to said median plane between the two thermal cutouts and can be constructed in the described manner.

Figure 8:
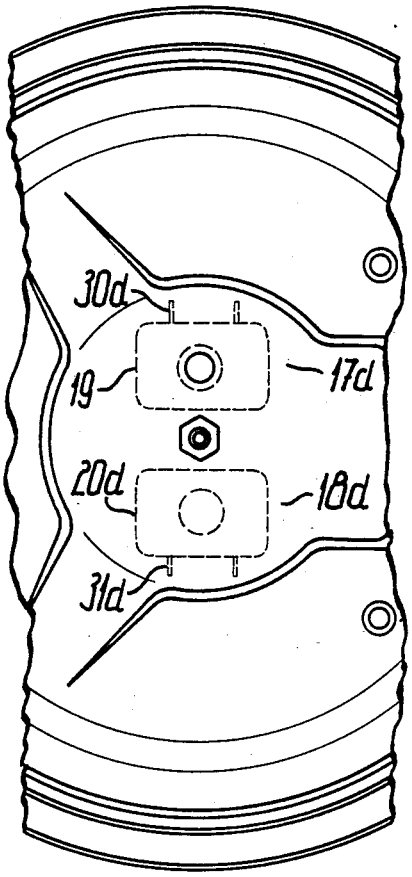

The thermal cutouts **17*d*, 18*d* according to FIG. 8 are two identical cutouts, which in each case have temperature sensors integrated into the associated cutout casing 19*d*, 20*d* and which function e.g. in the manner of spring disk switches. The connectors 30*d*, 31*d* are provided on remote sides of the cutout casing 19*d*, 20*d***.

Figure 9:
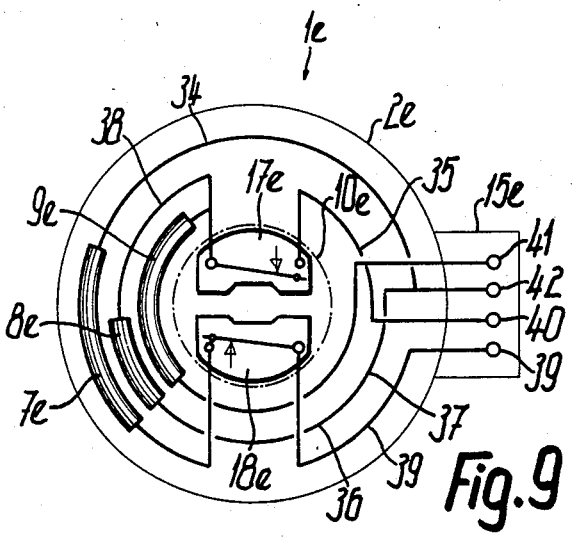

Of the three heating resistors **7*e*, 8*e*, 9*e* of the main heating system of electric hotplate 1*e* in FIG. 9, e.g. two heating resistors can have a power of approximately 850 W, whereas the third heating resistor 8*e* has a much lower power e.g. 300 W. The two leads 33, 34 or 35, 36 of the two larger heating resistors 7*e*, 9*e* are connected independently of one another to the four connecting terminals 39 to 42 of the connecting block 15*e*. The thermal cutout 18*e* is connected into one lead 33 of one larger heating resistor 7*e*, while the thermal cutout 17*e* is connected into a lead 35 of the other larger heating resistor 9*e*. A lead of the smaller heating resistor 8*e* is connected to that connecting terminal 42, to which is also connected the switch-free lead 34 of the larger heating resistor 7*e*. The other lead 38 of the small heating resistor 7*e* is connected to that lead 35 of the other large heating resistor 9*e*, in series with which is connected the thermal cutout 17*e*. Lead 38 is connected between thermal cutout 17*e* and said larger heating resistor 9*e*, so that heating resistor 8*e* can also be disconnected by thermal cutout 17*e*. If thermal cutout 17*e* opens, a large heating resistor 9*e* and the small heating resistor 8*e* are disconnected, whereas on opening thermal cutout 18*e* the other large heating resistor 7*e* is disconnected. In the construction according to FIG. 10, the two thermal cutouts 17*f*, 18*f* are so connected into the leads 36*f*, 34*f* from the connecting terminals 41*f*, 42*f* that on opening thermal cutout 17*f* only heating resistor 9*f* and on opening thermal cutout 18*f* both heating resistor 7*f* and heating resistor 8*f* are disconnected. Finally, in the embodiment according to FIG. 11, thermal cutout 17*g* is connected into the lead 36*g* from connecting terminal 41*g* and the thermal cutout 18*g* into the lead 33*g* from connecting terminal 39, in such a way that on opening the thermal cutout 17*g* one large heating resistor 9*g* is disconnected and on opening thermal cutout 18*g* the other large heating resistor 7*g* is disconnected. No thermal cutout is connected into the two leads to the small heating resistor 8*g*, so that on applying voltage to the associated connecting terminals 40*g*, 42*g* the small heating resistor 8*g* remains in operation, even if the two thermal cutouts 17*g*, 18*g*** have opened.

Figure 12:
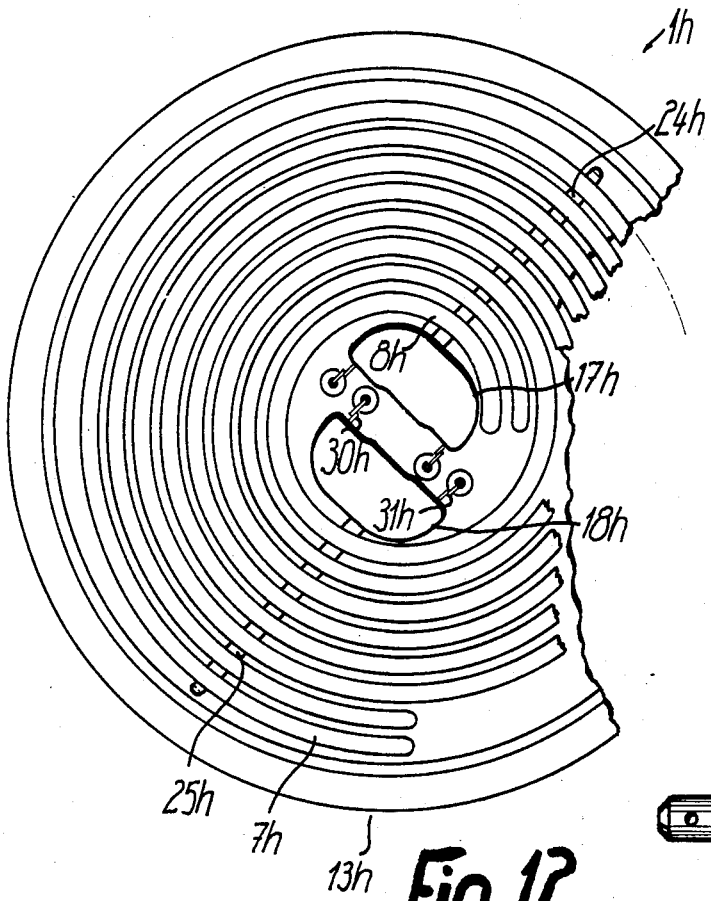
Figure 13:
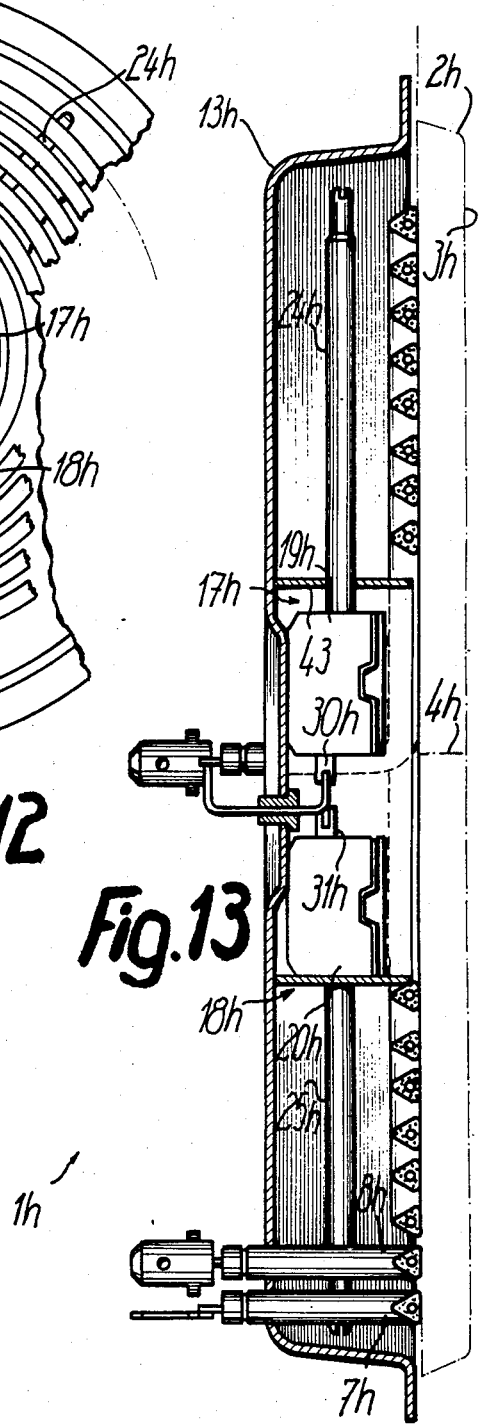

The construction according to FIGS. 12 and 13 provides a cooking point heating system, which can be simply and space-savingly housed, even under unfavourable space conditions and still ensures a precise monitoring of the temperature conditions in the vicinity of a tubular heater, particularly in the vicinity of the outer boundary of the heating field. This heating system is particularly suitable for ceramic, such as glazed ceramic cover plates 2*h* and for those cover plates which are fixed by bonding in cooking point openings of a hob. In the case of those cover plates, where particular care must be taken regarding overheating in the edge region, an arrangement of the cooking vessel in displaced manner with respect to the central axis of the cooking point in the resulting exposed region of the cover plate can lead to overheating. However, since at least one temperature sensor 24*h*, 25*h* extends approximately up to said peripheral region, the temperature rise is detected before overheating occurs and consequently tubular heater 7*h*, 8*h* is disconnected, so that overheating is not possible even under unfavourable conditions. The tubular heaters 7*h*, 8*h* have the same cross-section, which in the represented embodiment are of approximately equilateral triangular form. With the flattened top surface located in the plane of heating surface 3*h*, all the curved portions of heating bodies 7*h*, 8*h* form contact surfaces for the whole-area, slightly resilient, pressed engagement on the underside of the cover plate 2*h*, indicated by dot-dash lines in FIG. 13, whose top surface parallel to the bottom surface forms the base 3*h* for the cooking vessel to be heated and which can be larger than the periphery of the tubular heater, so that it completely covers the tubular heaters 7*h*, 8*h* in the upwards direction. The two cutout casings 19*h*, 20*h* are arranged on either side of an axial plane of the central axis 4*h* by means of their planar undersides on the raised, also planar portion of the inner face of the bottom wall of the cup-shaped cover 13*h* and their tops extend approximately to the level of the underside of the curved tubular heaters 7*h*, 8*h*. Each temperature sensor 24*h* or 25*h* extends over all the spiral turns of both tubular heaters 7*h*, 8*h* from the central zone approximately to the outer periphery 5 thereof. To each connecting lug 30*h* or 31*h* is fixed an electric line bent in U-shaped manner from a relatively rigid wire portion by means of its upper, approximately horizontal leg, whose approximately vertical cross-web passes through the base wall or a raised central portion in the vicinity of an inserted ceramic or similar material insulating bush placed in the cover 13*h* and whose leg located below the cover 13*h* is connected to the associated inner connecting end of the two tubular heaters 7*h*, 8*h* or carries an associated flat plug. Thus, for each thermal cutout 17*h* or 18*h*, the tilting moment acting thereon through the freely projecting temperature sensor 24*h* or 25*h* is merely resiliently absorbed by the two associated electric lines within narrow limits, so that on the one hand there is a very simple fixing of the thermal cutouts and on the other vibration protection is provided. Cover 13*h* forms the supporting base for tubular heaters 7*h*, 8*h*, as well as the thermal cutouts 17*h*, 18*h*, the heaters being fixed to the base exclusively in the vicinity of the passage of their angular ends through the base wall. The flat plugs are located directly below the base wall.

The cutout casings 19*h*, 20*h* can be spacedly surrounded by a cylindrical sleeve-like shield 43 located in central axis 4*h*, which in plan view is entirely located within the central zone and by means of its upper, planar and located below cover plate 2*h* projects upwards beyond the underside of tubular heaters 7*h*, 8*h*, in such a way that the upper end is higher than the top of the regulator casing 19*h*, 20*h* and is appropriately in the plane of the top of the outwardly directed edge flange of cover 13*h*. The particular temperature sensor 24*h*, 25*h* passes through the jacket of shield 43 between the ends thereof in the vicinity of an opening adapted to its external diameter, which further secures the thermal cutout. Shield 43 extends radially outside the raised portion on the base wall of cover 13*h* and is appropriately made from insulating material or at least contains insulating material, which can be a ceramic material.

Figure 14:
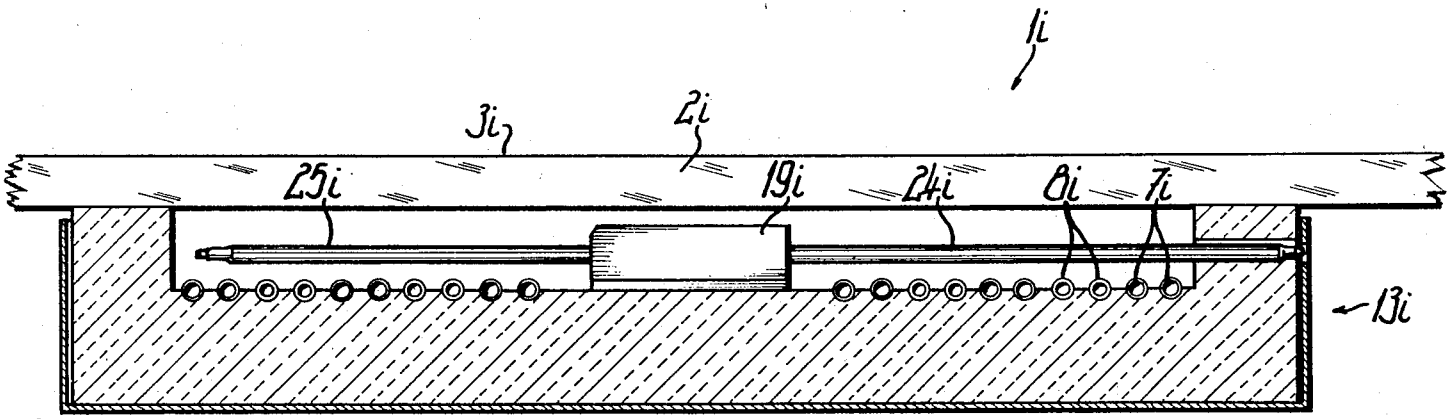

FIG. 14 shows a heating unit constructed as a radiant heater, which has a carrier tray 13*i* for receiving or holding the heating resistor 7*i*, 8*i*. This carrier tray 13*i* is provided with a relatively thick-walled inner tray made from insulating material, e.g. mineral fibers and/or pyrogenic silicic acid and/or vermiculite and a thin-walled outer tray of sheet metal or the like, which serves to grasp the inner tray. The heating resistor 7*i*, 8*i* are located on the bottom surface of the inner tray or are partly embedded therein and said resistors can also be formed by lamp bulbs, namely so-called light or bright radiators, such as e.g. tungsten halogen lamps. The end face of the outer rim of the inner tray scalingly or under pressure engages on the inside of the glass ceramic or the like, i.e. translucent heating plate 2*i*. In the central zone free from the heating resistors are arranged the two thermal cutouts 17*i*, 18*i* with a common cutout casing 19*i*, in such a way that the two temperature sensors 24*i*, 25*i* freely project in opposite directions and are located in contact-free manner in the space between heating resistor 7*i*, 8*i* on the one hand and the inside of heating plate 2*i* on the other. As shown in FIG. 14, the particular temperature sensor 24*i* can pass through the outer edge of the inner tray and/or the outer tray of carrier tray 13*i* and can consequently be supported at its outer end or can be accessible at all times for adjustment purposes. However, temperature sensor 25*i* can also project freely in the manner of a cantilever, so that its outer end is spaced with respect to the inner face of the outer edge of the inner tray. The cutout casing, which is generally made from a ceramic material, such as steatite, i.e. an insulating material can also be used for central shielding of the heating plate against radiant overheating.

I claim:

1. An electric cooker heating unit, comprising:

a heated unit body having an outer side defining a heating surface, an inner side behind said heating surface and a central zone;

an electric heater means for heating said heating surface, said electric heater means having at least two heating resistors arranged behind said heating surface adjacent to said central zone defining a heated region, the heated region having an inside;

a power control device for operating said heating resistors at different power ratings in power units formed at least partly by alternative switched connections among the heating resistors and a power source;

a thermal cutout device located behind the heating surface for disconnecting from the power source at least one of said heating resistors at a predetermined temperature setting, said thermal cutout device having a cutout casing means arranged in the central zone of said unit body and having a temperature sensing means for the unit body, and wherein the thermal cutout device includes a first and a second thermal cutout, the first and second thermal cutouts having two separate temperature sensors and the first and second thermal cutouts being operable at different temperature settings, the cutout casing means of the first and second thermal cutouts being arranged in the central zone and including at least one cutout casing, the first thermal cutout being arranged for disconnecting from the power source a first of said power units and the second thermal cutout means being arranged for disconnecting from the power source a second of said power units.

2. The heating unit of claim 1, wherein the two separate temperature sensors are disposed in different regions of the unit body, when the unit body is viewed in plan view.

3. The heating unit of claim 2, wherein the two separate temperature sensors are substantially aligned along a diameter of the unit body, when viewed in plan view.

4. The heating unit of claim 1, wherein the cutout casing means for the first and second thermal cutouts is formed by a common cutout casing.

5. The heating unit of claim 4, wherein the unit body is constructed as a hot plate body and has a central fixing projection projecting from the inner side of the unit body, the cutout casing being provided with an opening for engagement of the cutout casing on the central fixing projection.

6. The heating unit of claim 1, wherein the cutout casing means is formed by separate cutout for the first and second thermal cutouts casings.

7. The heating unit of claim 6, wherein the unit body has a central fixing projection, and the separate cutout casings are located on either side of the central fixing projection.

8. The heating unit of claim 1, wherein the unit body has an inner ring projecting on the inner side of the unit body, the inner ring having an outside and the inner ring defining the central zone, said temperature sensor means of at least one of said thermal cutouts extending to the outside of the inner ring.

9. The heating unit according to claim 1, wherein the temperature sensor means of at least one of said thermal cutouts is located behind the heating resistors.

10. The heating unit of claim 1, wherein the temperature sensor for at least one of said thermal cutouts is located on an inside of the heated region of the unit body, said heated region bearing the heating resistors.

11. The heating unit of claim 1, wherein the temperature sensor of at least one of said thermal cutouts extends substantially radially along the heated region.

12. The heating unit of claim 1, wherein the unit body defines a central axis, said temperature sensors being rod-like and positioned on opposite sides of the central axis, oriented in different directions.

13. The heating unit of claim 1, wherein the temperature sensors are rod-like and are positioned diametrically opposite one another.

14. The heating unit of claim 1, wherein the temperature sensors are rod-like and are positioned at a constant spacing from the heating surface and coextensively therewith.

15. The heating unit of claim 1, wherein at least one of said temperature sensors is an expansion rod sensor.

16. The heating unit of claim 1, wherein at least one of said temperature sensors is a bimetallic sensor.

17. The heating unit of claim 1, further comprising a cover arranged on the inner side of the unit body, and wherein the first and second thermal cutouts are located within the cover.

18. The heating unit of claim 17, wherein the first and second thermal cutouts are fixed on the unit body by means of said cover.

19. The heating unit of claim 17, wherein the cover has a base wall and at least one of said cutout casings is arranged directly on the base wall.

20. The heating unit of claim 19, wherein the base wall of the cover has an elevated portion, at least one of said cutout casings being arranged on the elevated portion.

21. The heating unit of claim 20, wherein the base wall of the cover includes an insulating bushing, at least one of said cutout casings being mounted on the unit by means of leads connected electrically to connecting means on the cutout casing, said leads passing through the base wall of the cover at the insulating bushing.

22. The heating unit of claim 21, wherein the leads are located on a side of the cutout casing remote from the temperature sensor means.

23. The heating unit of claim 17, further comprising a shield and wherein the shield is arranged on a bottom wall of the cover.

24. The heating unit of claim 1, wherein the heating resistors include at least one curved tubular heater located in the heated region and engaging on the inner side of a cover plate defined by the heated unit body, the heating resistors defining outer and inner peripheries and connection ends.

25. The heating unit of claim 24, wherein the connection ends and the cutout casing means are located within the outer periphery of the heated region when the unit body is viewed in plan view, the connection ends and the cutout casing means being located substantially close to the inner periphery of the tubular heater, and wherein at least one of said temperature sensors extends substantially up to said outer periphery.

26. The heating unit of claim 24, wherein the heating resistors include two juxtaposed tubular heaters, spirally curved in a plane, an innermost spiral turn of the tubular heaters defining the central zone and an outermost spiral turn of the tubular heaters defining the periphery of the heated region, at least one of the tubular heaters in cross section being flattened substantially parallel to the heating surface at least on a side of the at least one tubular heater facing the unit body.

27. The heating unit of claim 1, wherein at least one of the cutout casings has a top surface facing the unit body, the top surface of the at least one of the cutout casings being located substantially in a plane of a near side of at least one of the heating resistors, the at least one heating resistor being curved and the rear side facing away from the unit body.

28. The heating unit of claim 1, further comprising a shield, at least one of said cutout casings being located in the shield.

29. The heating unit of claim 28, wherein the shield is traversed by the temperature sensor means.

30. The heating unit of claim 28, wherein said shield is formed as a sleeve extending over the rear side of the heating resistor.

31. The heating unit of claim 28, wherein the shield contains insulating material.

32. The heating unit of claim 28, wherein the shield is made of insulating material.

33. The heating unit of claim 1, wherein at least one of the heating resistors is formed by a radiant heater arranged in a carrier tray therefor, made at least partly of insulating material.

34. The heating unit of claim 33, wherein at least one of the temperature sensors is positioned in non-contacting manner between the heating resistor and the unit body, the unit body being plate-like and made of a glass ceramic material.

35. The heating unit of claim 1, wherein the first and second thermal cutouts are connected to separate leads running between the power control device and the heating resistors.

36. The heating unit of claim 1, wherein the first and second thermal cutouts are connected into two of a total of four leads running between the power control device and the heating resistors.

37. The heating unit of claim 1, wherein one of said thermal cutouts is connected into a common lead connected to two of the heating resistors.

38. The heating unit of claim 37, wherein the two heating resistors have different power ratings.

39. The heating unit of claim 1, wherein more than two heating resistors are provided, the first and second thermal cutouts each being connected into a lead of one of two of said heating resistors, each of which has a higher power rating than a third of the heating resistors.

40. The heating unit of claim 39, wherein the two heating resistors have substantially equal power ratings.

* * * * *